United States Patent [19]

Jousson

[11] 4,111,193

[45] Sep. 5, 1978

[54] PULSED LIQUID HYGIENE APPARATUS

[75] Inventor: Pierre J. Jousson, Geneva, Switzerland

[73] Assignee: Les Produits Associes LPA S.A., Switzerland

[21] Appl. No.: 779,532

[22] Filed: Mar. 21, 1977

[30] Foreign Application Priority Data

Apr. 8, 1976 [CH] Switzerland ..... 4414/76

[51] Int. Cl.[2] ..... A61H 9/00

[52] U.S. Cl. ..... 128/66; 128/62 A

[58] Field of Search ..... 128/66, 62 A, 230

[56] References Cited

U.S. PATENT DOCUMENTS

| | | | |
|---|---|---|---|
| 3,393,673 | 7/1968 | Mattingly | 128/66 |
| 3,453,969 | 7/1969 | Mattingly | 128/66 X |
| 3,861,383 | 1/1975 | Kovach | 128/66 |
| 3,952,736 | 4/1976 | Moret et al. | 128/66 |

*Primary Examiner*—Lawrence W. Trapp

*Attorney, Agent, or Firm*—Robert E. Burns; Emmanuel J. Lobato; Bruce L. Adams

[57] ABSTRACT

A return pipe for recycling liquid from a handpiece of a pulsed-liquid hygiene apparatus to a hydraulic motor is connected to the top of a relief flue above the working chamber of the motor by a coupling element which imparts a helicoidal movement to the returned liquid thus slowing its fall in the flue.

7 Claims, 7 Drawing Figures

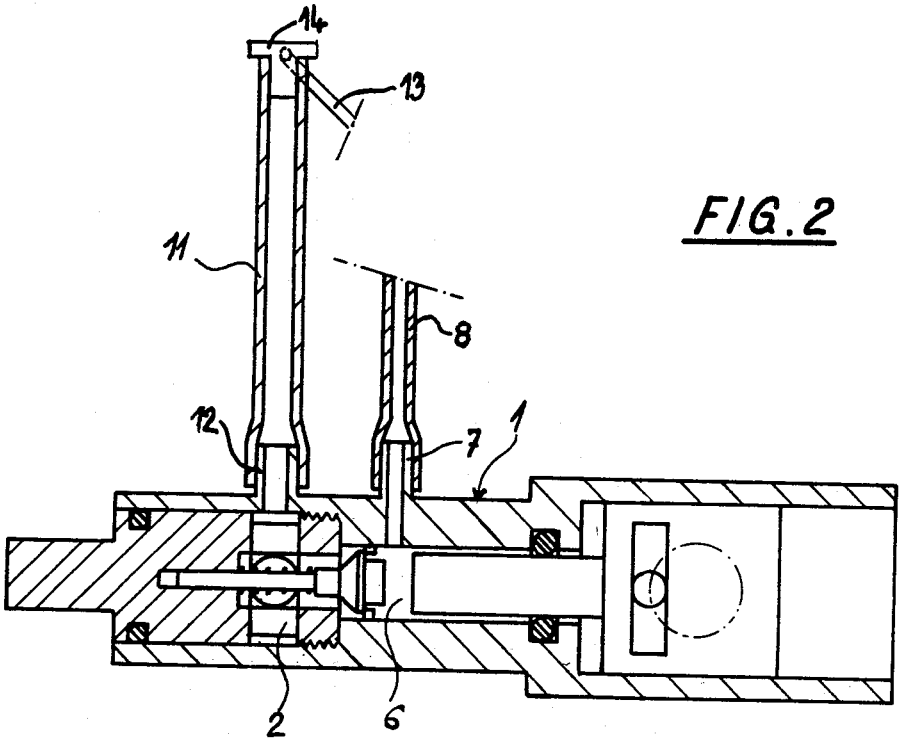
FIG. 2
FIG. 3
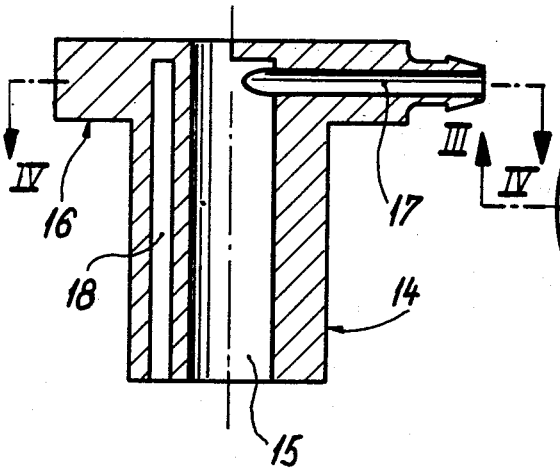
FIG. 4
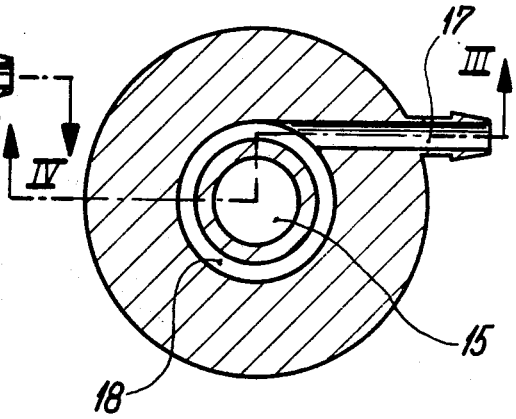

PULSED LIQUID HYGIENE APPARATUS

The invention concerns apparatus for body care, in particular for the massage of gums and cleaning teeth, of the type comprising a piston pump supplied with liquid from a reservoir and connected to a hydraulic motor mounted in a hand-held casing or handpiece, this motor driving a treatment instrument. In a known apparatus, the pump comprises an intake chamber connected to an inlet conduit leading from the reservoir, a piston reciprocated by a motor, a working chamber connected to an outlet conduit itself connected to the hydraulic motor, and an inlet valve disposed in a passage between the intake and working chambers to close this passage during the operative stroke of the piston and open it in the suction stroke. A vertical relief flue leaves the working chamber and is open at its upper end which is higher than the level of the reservoir, and a return pipe is provided for returning liquid from the handpiece to the hydraulic motor.

Such apparatus may be adapted for brushing teeth, the hydraulic motor in the handpiece serving to oscillate a stem on which a tooth brush is fitted. A valve actuated by a control member enables either the hydraulic motor to be running or short-circuited so that the pump runs idle. Certain known apparatus enable the use of either a tooth brush or a spray nozzle; in this instance, the closure valve of the hydraulic motor is a several-way valve. In the apparatus known up to now, the return pipe is directly connected to the liquid reservoir, the connection being provided either by temporarily fixing the pipe to the edge of the reservoir, or by connecting it to an adaptor provided in a wall of the reservoir. This temporary fixing of the return pipe is not very convenient and is liable to cause accidents in the case of clumsy handling.

Another known apparatus for body care has a relief flue open at its upper end and which protrudes from the inlet chamber so that the reservoir, the intake chamber of the pump and the relief flue form a system of communicating vessels guaranteeing complete filling of the intake chamber as soon as the reservoir full of liquid is connected to the inlet conduit of the pump, air thus being able to completely escape from the intake chamber by the relief flue, the liquid level in the flue becoming the same as in the reservoir. But to date, this improvement has only been incorporated in apparatus with a spray nozzle operating without a liquid-return pipe.

The invention propose to combine the advantages of apparatus of the described type having a liquid-return pipe with the advantages of an apparatus having a relief flue, and which may be used either for brushing the teeth, or for massaging of the gums with a pulsed jet.

To this end, the apparatus according to the invention is characterized in that the return pipe is connected to the inlet chamber via a coupling element fixed in the upper end of the relief flue, this coupling element having an axial opening placing the relief flue in communication with the ambient air and means for slowing of the fall of liquid from the return pipe into the relief flue.

In this manner the return liquid is recycled to the pump via the relief flue without impeding the correct operation of this relief flue and without allowing air bubbles to penetrate into the circuit.

The accompanying drawings show, by way of example, an embodiment of the invention and a varied form of coupling element. In the drawings:

FIG. 2 is a cross-section along line II—II of FIG. 1;

FIG. 3 is an enlarged-scale view of a coupling element in cross-section along line III—III of FIG. 4;

FIG. 4 is a cross-section along line IV—IV of FIG. 3;

Figure 1:
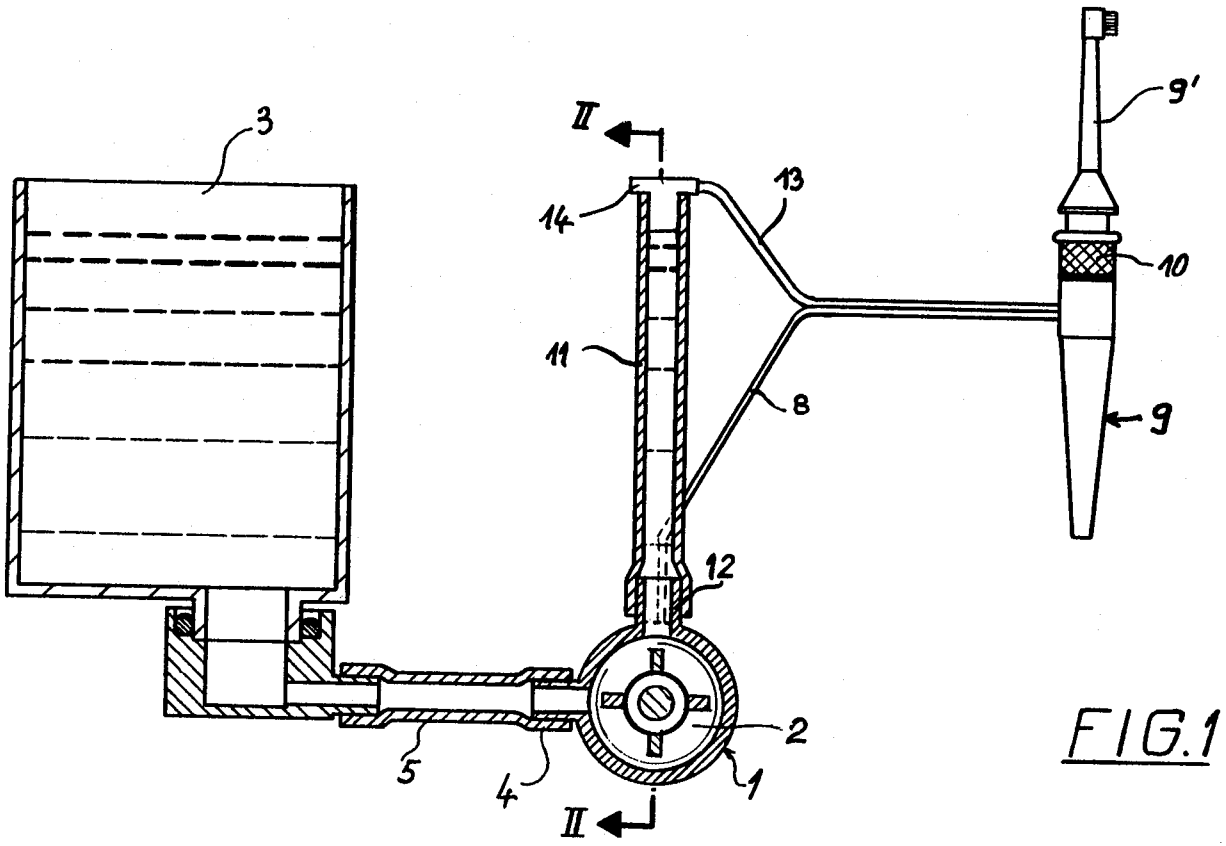
FIG. 1 is a schematic view of the apparatus according to the invention in partial cross-section.

With reference to FIGS. 1 and 2, the apparatus comprises a pump 1 having an intake chamber 2 connected to an open-topped liquid reservoir 3 via an inlet tube 4 and a pipe 5, and a working chamber 6 connected via an outlet tube 7 and a flexible pipe 8 to a casing in the form of a handpiece 9 in which is mounted a hydraulic motor having a control member 10 which can be actuated by the user to control driving of a working instrument, in this instance a toothbrush 9'.

A vertical relief flue 11, open at its upper part, is fixed on a neck 12 leading out of the intake chamber 2 of pump 1, this relief flue 11 forming with the chamber 2 of the pump, the pipe 5 and reservoir 3 a system of communicating vessels.

The control member 10 of the casing 1 handpiece 9 may occupy two positions, an "on" position in which it allows the liquid to control the hydraulic motor and a "off" position in which the pressurized-liquid inlet pipe 8 is connected to a return pipe 13, itself connected to the intake chamber 2 via a coupling element 14 having a shank plugged in the upper end of the relief flue 11.

The coupling element 14, illustrated in FIGS. 3 and 4, is in the form of a cylindrical stopper provided with a cylindrical central opening 15 and a retaining shoulder 16 by which it bears on the upper end of the relief flue 11. The return pipe 13 is connected to a connecting duct 17 perpendicular to the direction of the opening 15 and which leads into an annular conduit 18 disposed coaxially about said central opening 15 and closed at its upper end. The duct 17 leads tangentially into the annular conduit 18 so as to impart to the return liquid from the handpiece a downwards helicoidal movement slowing its fall and avoiding the formation of air bubbles in the liquid contained in flue 11.

Figure 5:
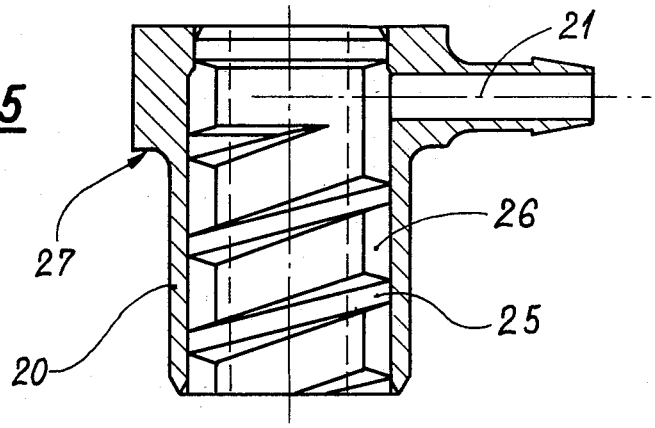
FIG. 5 is a view in longitudinal cross-section of a varied coupling element.
Figure 6:
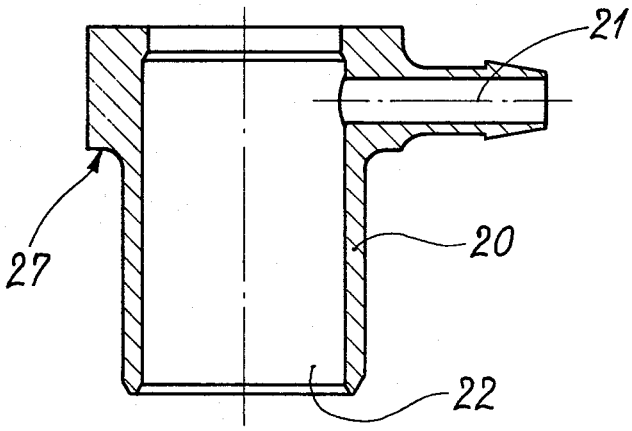
FIG. 6 is a view in longitudinal cross-section of an external component of the coupling element of FIG. 5.
Figure 7:
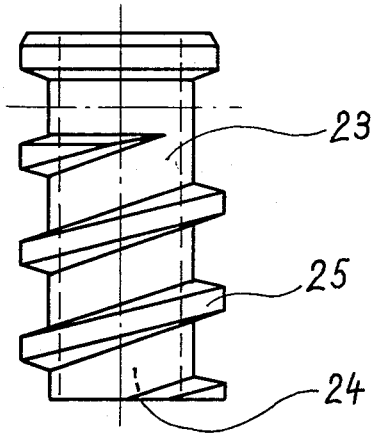
FIG. 7 is an elevational view of an inner component of the coupling element of FIG. 5.

FIGS. 5 to 7 show a varied coupling element which is formed of a first outer piece 20 provided with a connecting duct 21 and an external shoulder 27. Piece 20 also has an axial cylindrical opening 22 in which is force fitted a second piece 23 provided with a cylindrical bore 24 and, on its outer face, a helicoidal rib 25 which defines, with the inner wall of piece 20, a helicoidal 26 into the upper part of which the duct 21 leads. The helicoidal conduit 26 imparts to the return liquid a downward helicoidal movement which slows its fall and avoids the formation of air bubbles in the liquid contained in the relief flue 11.

What is claimed is:

1. In an apparatus for body care, in particular for the massage of gums and cleaning teeth, comprising a piston pump; a liquid reservoir; a hydraulic motor disposed in a hand-held casing to drive a treatment instrument; said pump comprising an intake chamber connected to an inlet conduit leading from the reservoir, a piston reciprocated by a motor, a working chamber connected to an outlet conduit which is connected to said hydraulic motor and an inlet valve disposed in a passage between the intake and working chambers to close said passage during the operative stroke of the piston and open said passage in the suction stroke; a vertical relief flue leaving the working chamber end open at its upper end which is higher than the maximum liquid level of the reservoir; and a return pipe for returning a liquid from the hand-held casing to the hydraulic motor, the improvement wherein said return pipe is connected to said intake chamber via a coupling element fixed in the upper end of the relief flue, said coupling having an axial opening placing the relief flue in communication with the ambient air and means for slowing of the fall of liquid from the return pipe into the relief flue.

2. An apparatus according to claim 1, in which the coupling element has disposed coaxially about said axial opening placing the relief flue in communication with the ambient air, an outer conduit connecting the return pipe to said relief flue via a connection duct protruding perpendiuclar to the axis of said element.

3. An apparatus according to claim 2, in which said axial opening and coaxial conduit are oriented vertically, the axial opening being cylindrical and the outer conduit annular, said connecting duct leading tangetialy into an upper end of the annular conduit to impart a helicdoial movement to liquid returning from the return pipe to slow its fall.

4. An apparatus according to claim 3, in which the coupling element is in one piece and the annular conduit is closed at its upper end.

5. An apparatus according to claim 2, in which the axial opening is cylindrical and the outer conduit is helicoidal, said connecting duct leading perpendicularly into the upper end of the helicoidal conduit to impart a downward helicoidal movement to liquid returning from the return pipe to slow its fall.

6. An apparatus according to claim 5, in which the coupling element is formed of two interfitting pieces, an outer piece having a cylindrical opening into which the connecting duct leads, and an inner piece fitted in said cylindrical opening, the inner piece having an axial bore forming said axial opening and, on its outer face, a helicoidal rib which defines with the inner wall of the outer piece said helicoidal conduit.

7. An apparatus according to claim 1, in which the coupling element comprises a shank fitted in the relief flue and/a retaining shoulder at its upper end.

* * * * *